United States Patent [19]

Ueda et al.

[11] 4,340,800

[45] Jul. 20, 1982

[54] HEATING APPARATUS HAVING VOICE COMMAND CONTROL OPERATIVE IN A CONVERSATIONAL PROCESSING MANNER

[75] Inventors: Shigeki Ueda, Nara; Teruhisa Takano, Osaka, both of Japan

[73] Assignee: Matsushita Electric Industrial Co., Ltd., Kadoma, Japan

[21] Appl. No.: 217,685

[22] Filed: Dec. 18, 1980

[30] Foreign Application Priority Data

Dec. 21, 1979 [JP] Japan ..... 54-167407

[51] Int. Cl.[3] ..... H05B 6/68

[52] U.S. Cl. ..... 219/10.55 B; 179/1 VC; 219/10.55 R

[58] Field of Search ..... 219/10.55 B, 10.55 E, 219/10.55 M, 10.55 R; 179/1 VC

[56] References Cited

U.S. PATENT DOCUMENTS 3,286,031 11/1966 Geddes ..... 179/1 VC
3,944,736 3/1976 Shepard ..... 179/1 VC
3,998,045 12/1976 Lester .
4,016,540 4/1977 Hyatt .
4,158,759 6/1979 Mason .
4,190,756 2/1980 Foerstner .

FOREIGN PATENT DOCUMENTS 2373117 8/1978 France ..... 179/1 VC

*Primary Examiner*—Arthur T. Grimley
*Attorney, Agent, or Firm*—Cushman, Darby & Cushman

[57] ABSTRACT

A heating apparatus incorporating a voice-actuated control system. The control system operates in four (4) modes. A first mode allows the user to select among previously stored cooking, defrosting or heating programs. After a program is selected, the apparatus changes to a second mode wherein it makes an inquiry of the user related to the program selected. After the inquiry is answered, in a third mode of operation, the apparatus changes to a fourth mode of operation to implement the selected program, as modified by a user's voice command in the third mode. By requiring a user response from among a small class of possible responses for a given selected program, the apparatus is unlikely to begin a heating cycle without specific confirmation by a user and therefor its safety is enhanced.

4 Claims, 15 Drawing Figures

HEATING APPARATUS HAVING VOICE COMMAND CONTROL OPERATIVE IN A CONVERSATIONAL PROCESSING MANNER

RELATED APPLICATIONS

This application is directed to subject matter that is related to the subject matter of the following co-pending applications, all filed on Dec. 18, 1980; TAKANO et al Ser. No. 217,657; UEDA et al Ser. No. 217,684; and UEDA et al Ser. No. 217,653.

BACKGROUND OF THE INVENTION

1. Field of the Invention

The present invention relates to a heating apparatus, to which a operation commands can be given by voices instead of by pushing switches by hand. More specifically, the present invention improves upon known voice-controlled apparatus by providing voice-controlled operation that occurs in a conversational processing manner.

2. Prior Art

Recently, studies have been made in an effort to introduce a control system activated by use of voices, letters or words, signs or picture as an aid or guide for inputting instructions into an electronics system, in order to attain easier and more natural communication between a user and the system. Especially, the use of a voice is attracting much attention as the most natural communication measure between man and machine, and the use of the voice in controlling an apparatus becomes more and more practical, as the semiconductor technology develops and provides significant impacts triggered by the rapid rise of memory capacity available through higher and higher circuit integrations in memory devices, and by an appearance of the microcomputor used as a controlling unit, and providing fast calculations and data manipulation.

However, the art of voice recognition is not sufficiently developed to provide perfectly accurate recognition even when the number of users is limited. Therefore, it is not only necessary to provide sophisticated hard ware in a voice recognition system of an apparatus, but also it is important to tactfully assemble the apparatus so as to prevent fatal accident that may result from overheating due to an incorrect interpretation of a voice command by the voice recognition circuit. Since the heating apparatus includes an electric heater or a microwave heating system, an erroneous operation of the apparatus without a load therein might cause an enclosure case and/or a door of the apparatus to become heated to a high temperature, thereby causing liability of burning of the user's hands or, even worse, a fire, or at least a damaging of the enclosure case or door or microwave oscillator, heater or other elements.

SUMMARY OF THE INVENTION

The present invention provides a heating apparatus capable of, instead of pushing many switch buttons, controlling its operation by voice command. In the apparatus, a voice recognition can be confirmed by the operator through working of the apparatus such that, after a first receiving of the voice command by a microphone and a recognition of it by a recgonition circuit, the apparatus outputs a synthetic voice or a confirmation statement or a question which has a close relevancy to the command. Through the contents of the statement or the question, the operator can know whether his command has been appropriately recognized by the apparatus, and thereafter by his next vocal command the apparatus proceeds its working process. By such a confirmation voice from the apparatus followed by a second voice command, the probability of undesirable erroneous operation, which might cause an accidental burning or fire, can be minimized.

DESCRIPTION OF THE PREFERRED EMBODIMENT

Figure 1:
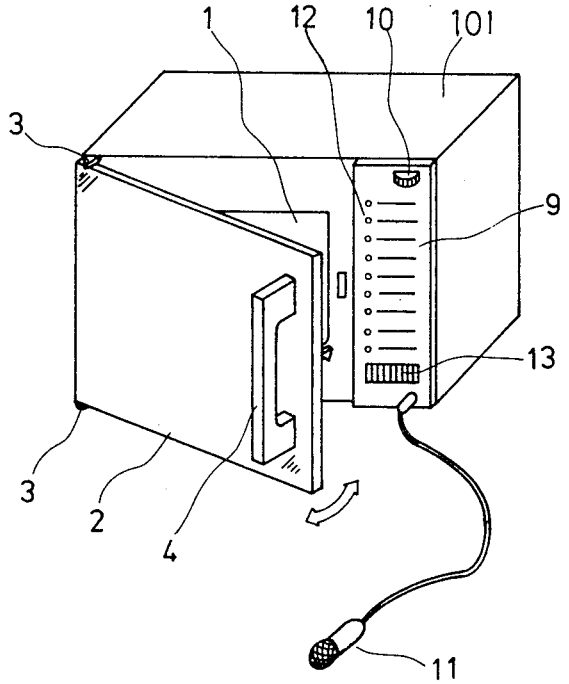
FIG. 1 is a perspective view of a heating apparatus embodying the present invention.

A heating apparatus in accordance with the present invention comprises:

(a) an enclosure case having therein a heating chamber in which an object to be heated is to be placed, the enclosure case having a door at an opening of the heating chamber, and (b) a heating means for radiating a heating energy to be fed in the heating chamber, wherein the improvement is that the heating apparatus comprises:

(c) a voice command input means including a microphone which transforms user's command voice into command input signals, (d) a pattern analyzer which analyzes the command input signals, subsequently samples them and carries out A/D conversion thereof to produce pattern-analyzed input signal data, (e) an input pattern memory which memorizes the pattern-analyzed input signal data, (f) a reference pattern memory which stores time sequential pattern data of predetermined number of pattern-analyzed reference signal data, (g) a recognition circuit which compares the pattern-analyzed input signal data with the reference pattern and determines a pattern affinity, and produces at least a predetermined control signal corresponding to a recognized command, when the affinity is more than a preset level, (h) a voice synthesizer which, based upon the output signal of the output control circuit, synthesizes a voice output signal, (i) a speaker which produces a sound by receiving the voice output signal, (j) a voice synthesizer memory which preliminarily stores and feeds the voice synthesizer with necessary voice pattern data, (k) a timer which counts a time period between an issuance of the voice output and subsequent receiving of a second command voice signal, and (l) a main control unit for controlling the abovementioned component parts in a manner to have sequential operation comprising a first voice recognition mode (m-1), a voice synthesizing mode (m-2), a second voice recognition mode (m-3) and an enforcing mode (m-4) in this order, wherein (m-1) in the first voice recognition mode, the control unit makes the voice command input means receivable of any voice command, and shifts the sequential operation to the voice synthesizing mode upon issuance of said predetermined control signal, (m-2) in the voice synthesizing mode, the control unit makes the voice synthesizer synthesize a voice output signal to ask the user to speak a second voice command to the voice command input means, and immediately thereafter makes the sequential operation to the second voice recognition mode, (m-3) in the second voice recognition mode, the control unit makes said voice command input means receivable of only limited number of predetermined voice commands, makes the sequential operation to the heating-means-switching mode when one of the predetermined voice commands is received by the voice command input means within the time period set by the timer, and makes the sequential operation again to the first voice recognition mode when none of the predetermined voice command is received by the voice command input means, and (m-4) in the enforcing mode, the control unit makes an enforcing of said command which is recognized in said first and second recognition modes.

The pattern analyzer comprises a filter bank comprising band-pass filters each having a different center frequency, by which the voice command signal is analyzed with respect to frequency, sampled and converted into digital data, and the digital data of the voice command signal are once memorized as time sequential pattern data in the input pattern memory.

First, the overall operation of the apparatus will be explained. The main control unit controls the sequential operation in the abovementioned order, that is, a first voice recognition mode, a voice synthesizing mode, a second voice recognition mode and a heating-means-switching mode.

At first, when the apparatus is switched to operate in the first recognition mode (m-1), the apparatus waits for any voice command input through the microphone. In this state of first recognizing mode, a voice command input signal such as, for example, "ROAST BEEF" is subjected to pattern-analyzing. The analyzed pattern is sampled and subsequently analog-digital (A/D) converted. The connected data is memorized time sequential pattern data in an input pattern memory. A recognizing process then compares the memorized pattern-analyzed data of the input signal for the voice command previously stored pattern-analyzed data of a reference signal. Thus, the recognition circuit performs a recognition process and produces and affinity signal representing the affinity degree i.e. the degree of correlation between the pattern-analyzed input signal and the pattern-analyzed reference signal. When the affinity signal exceeds a preset level, the output control circuit issues an identity signal to the voice synthesizer, thereby shifting the apparatus into the voice synthesizing mode (m-2). The voice synthesizer produces signal of voice, for example, "MEDIUM?" which has relevancy to the voice command "ROAST BEEF".

In the voice synthesizing mode (m-2), the voice synthesizer synthesizes voice by reading its memory. During this voice synthesizing mode, a gate circuit provided in the pattern analyzer is closed (OFF), so as not to accept any input signal of the voice command, thereby to prevent an recognition.

Thereafter, the mode of the operation is changed to the second recognition mode (m-3). When spoken by the apparatus with synthesized voice, the user answers to the microphone, saving for example, "YES", "WELL-DONE" or "RARE". Such second command voice is then again pattern-analyzed and after the similar process as in the first recognition mode, the command is recognized. However, this time, the comparison for recognition is made only with limited number of predetermined voice commands. For example, in this second recognition stage, "YES", "WELL-DONE", "RARE" and "PARDON?" are only acceptable reference information, and other voice commands, such as "DEFROSTING" or "HAMBURGER" is not recognized. And, if the voice command of one of "YES", "WELL-DONE" and "RARE" is given to the microphone, the control circuit change the operation mode to the enforcing mode (m-4). In this enforcing mode, a switching device allowing the heating means to operate may be switched on. However in order to attain a higher reliability in the enforcing mode (m-4), a desired heating sequence is preset in the apparatus and the operation advances to a start-waiting state. As will be elucidated later in detail, a start confirmation program can be provided before actual starting of a heating process. In case the voice command of "PARDON?" is given from the user, such as when he can not clearly understand the synthesized voice, the mode is restored to the voice synthetizing mode (m-2). In mode (m-2), the synthesized voice message, for example "MEDIUM?", which was issued immediately before is issued again, and immediately thereafter, the operation mode is changed again to the second recognition mode (m-3).

In this second recognition mode (m-3), if, for example, due to an in appropriate response from the user, a voice command such as "DEFROST", which is not among the selection group for the second recognition, but has been registered in the pattern memory of the apparatus, is given to the microphone, then the main control unit erases the already recognized first command voice of "ROAST BEEF" and restores the whole operation to the first voice recognition mode (m-1).

Upon enterring into this second recognition mode (m-3), the main control unit makes the timer circuit start, which counts time from the starting. If there is no new command voice given within a preset time counted from the starting, the previous first command voice input is regarded as erroneous and is erased, and the operation is restored to the first recognition mode.

Furthermore, if the voice command given by a user when the apparatus is operating in the first or the second recognition modes (m-1) or (m-3) is such that there is no affinity signal sufficient to make the output control circuit produce a control signal, the main control circuit switches the operation to the voice synthesizing mode (m-2) wherein then a synthesized voice of "pardon?" is synthesized and issued from the speaker. After issuance of such synthesized voice, the operation is restored to the first recognition mode in case the mode immediately before the issuance of "pardon?" was the first recognition mode (m-1), or to the second recognition mode in case the mode immediately before the issuance of "pardon?" was the second recognition mode (m-2).

Using this arrangement of the apparatus and its operation, the apparatus first hears the first voice command (in (m-1) mode), secondly it inquires of the user a question by the issuance (in (m-2) mode) of words which are synthesized in the apparatus and have contents closely related to the first voice command, and thirdly again hears the second voice command (in (m-3) mode) and confirms the relevancy of the contents of the second voice command with the first command thereby approving an accuracy of the first recognition, and only thereafter, the apparatus actually proceeds to switching on the heating apparatus or presets a selected heating sequence.

The preferred embodiment will be elucidated hereinafter referring to the attached drawings.

Figure 2:
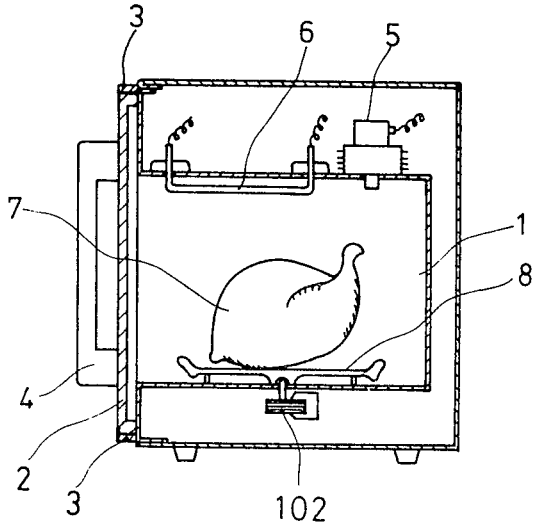
FIG. 2 is a sectional side view of the apparatus of FIG. 1.

The mechanical structure of an example of the heating apparatus in accordance with the present invention is shown in FIG. 1 and FIG. 2, wherein an enclosure case 101 comprises a heating chamber 1 wherein an object 7 to be heated such as food is to be placed. The heating chamber 1 has a door 2 with a handle 4 and mounted by hinges 3 to the enclosure case 101. The heating apparatus has a magnetron 5 which radiates microwave radiation into the heating chamber 1 and an electric heater 6 which produces resistive heat from commercial AC current. The apparatus comprises a built-in microphone 10 on an operation panel 9 and/or a wire-connected hand microphone 11 which constitutes an input end part of a voice command input means. The panel 9 further comprises a speaker 13 and a row of sequence indication lamps 12. When preferred, the heating chamber 1 comprises a turntable 8 for rotating the heating object 7 for uniform heating, and a motor 102 under a chamber floor.

For heating, the heating object 7 is put into the heating chamber 1 by opening the door 2. At first, the apparatus is in the first mode (m-1) to heat a first voice command. Then, the user speaks a first voice command such as "ROAST BEEF" to the microphone 10 or 11. The first voice command is for selecting the kind of heating sequence, such as "ROAST BEEF", "ROAST CHICKEN", "DEFROSTING", etc. When the first voice command is clearly recognized, the first recognition indication lamp in the indication lamps 12 is lit and the apparatus changes its operating mode to the second mode (m-2) for enquiry where the speaker 13 tells the user an enquiry having a close relevancy to his first voice command, such as "MEDIUM?" in response to the voice command of "ROAST BEEF".

Then, the apparatus operation changes to a third mode for a second recognition (m-3) and the user answers to the microphone 10 or 11 with a second voice command such as "YES". In this second recognition mode (m-3) the apparatus can recognize several necessary voice commands which are related to the first voice command. That is, for example, for the first voice command of "ROAST BEEF", the apparatus should have an ability to select among roastings of "RARE", "MEDIUM " and "WELL-DONE". And therefore, if the enquiry is set as "MEDIUM", other two, namely "RARE" and "WELL-DONE" are memorized in the apparatus besides "YES" for the recognizable voice commands, and recognitions of these four words are made available by the first voice command input of "ROAST BEEF".

Figure 3:
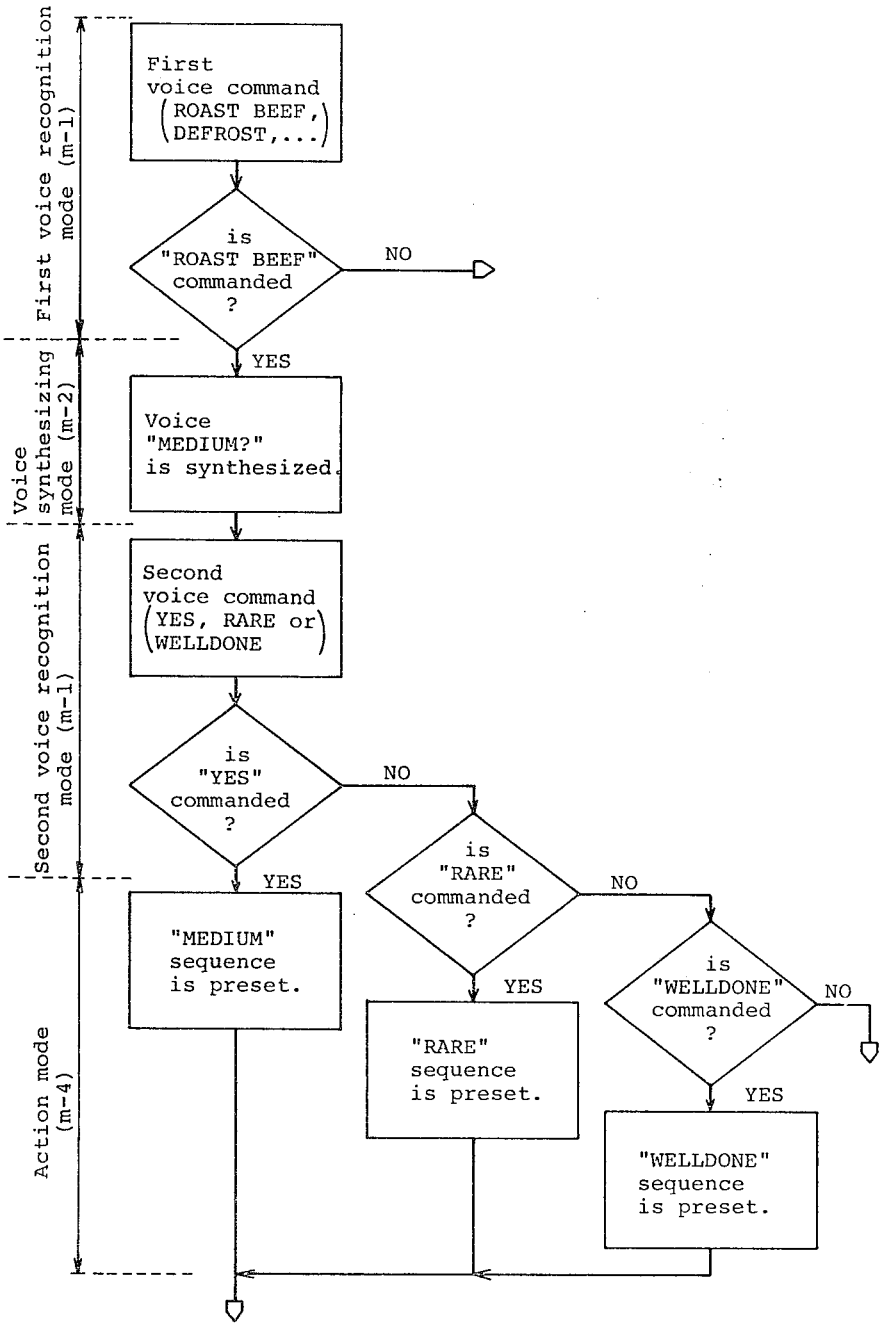
FIG. 3 is a program flow diagram showing a program of recognition for selection of a heating sequence command in the embodiment in accordance with the present invention.

FIG. 3 shows a program flow chart of a main control unit which carries out the abovementioned command voice recognition procedure. Details of respective modes will be elucidated later.

By provision of the first and the second recognition modes (m-1) and (m-3) together with en enquiring or telling mode (m-2) inbetween, an erroneous recognition of the voice command and resultant erroneous operation of the heating apparatus can be substantially eliminated. Furthermore, if the user hears unexpected enquiry issued from the apparatus, he can immediately know an erroneous recognition by the apparatus, and will repeat genuine command. Thus, dangerous processing into actual heating based on erroneous recognition of the voice command, namely mishearing by the apparatus, can be substantially prevented. Furthermore, since plural heating sequences, such as, "RARE", "MEDIUM" and "WELL-DONE" can be called up by a single voice command of kind of cooking in the menu, such as "ROAST BEEF", a selection of a desired heating sequence among many heating sequences can be easily made, and therefore, number of indication lamps on the panel can be made small. Besides, by use of the sequential use of key words, namely the first voice command and the second voice command, the erroneous selection of the sequence can be avoided.

Selection of an operating sequence can be made for the sequences other than those used for cooking can be made in the same way. That is, it is possible to constitute the apparatus in such a manner that a user could select the heating sequence not only designating a kind of cooking in the menu, but also sequences for other heating purposes such as "DEFROSTING" or "DRYING".

Figure 4:
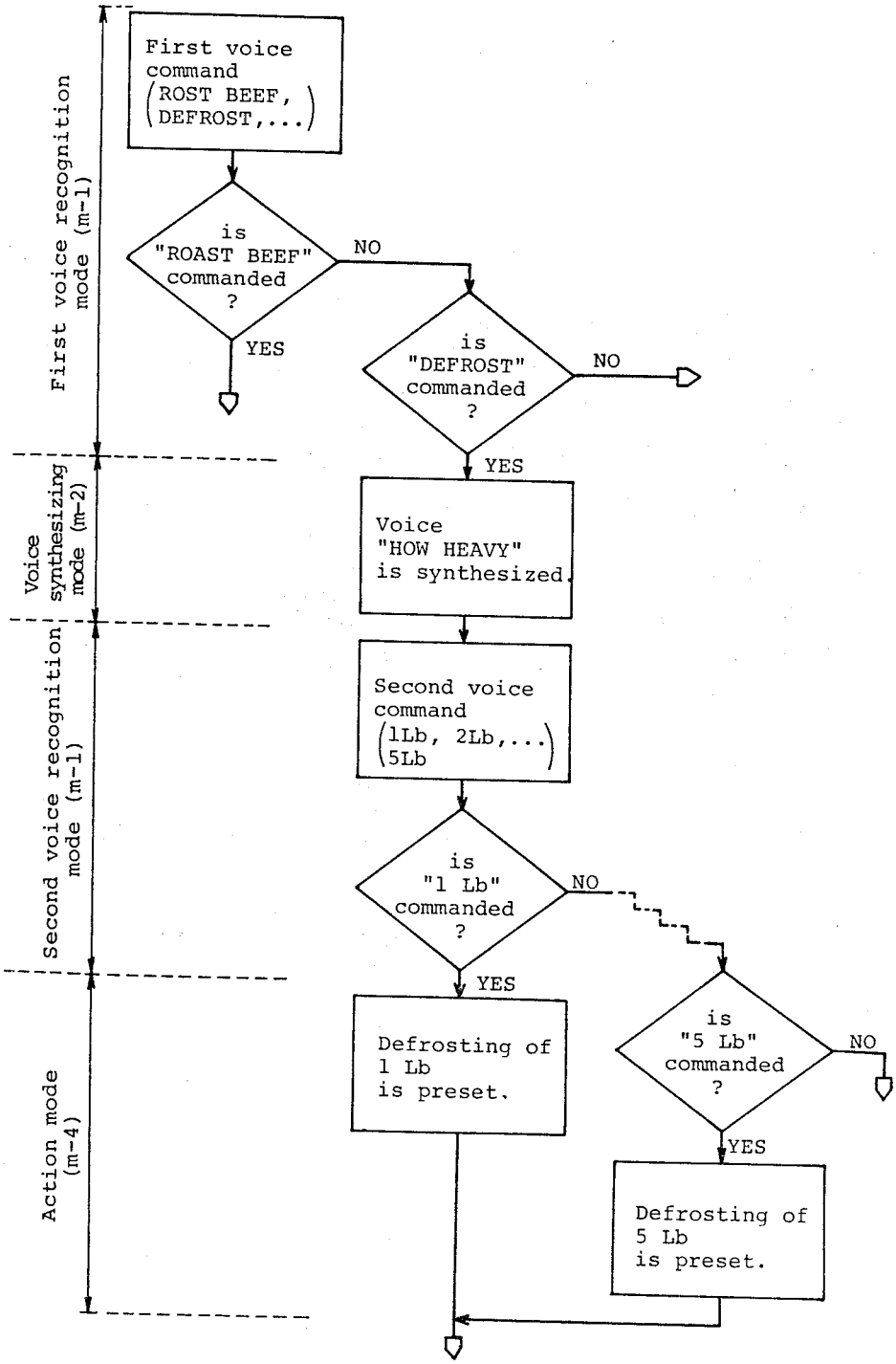
FIG. 4 is a program flow diagram showing another program of recognition for another selection of a heating sequence command in the embodiment.

For example, a first voice command of "DEFROSTING" is preset and second voice commands of several heating sequences for further selections of kind of frozen foods such as frozen meat, frozen vegetables, or frozen soup, etc. and or selections of weights thereof, are preset. Then, by giving the first voice command "DEFROSTING", the voice synthesizer issues an enquiry "HOW HEAVY?", and at immediately thereafter, the above-mentioned several heating sequences are called up for the second recognition. FIG. 4 is a program flow chart showing the abovementioned flow of the command voice recognitions of the defrosting sequence and further weights of defrosting object. As shown in FIG. 4, the voice command "DEFROSTING" is given as the first voice command, and in the first voice recognition mode, the recognition of the "DEFROSTING" is made after the first judging of 'is "ROAST BEEF" commanded?' made the judging of "NO". And then, after the enquiry "HOW HEAVY?" the apparatus is prepared to recognize the second voice commands of weight, 1 Lb, 2 Lb, 3 Lb, . . . 5 Lb.

Figure 5:
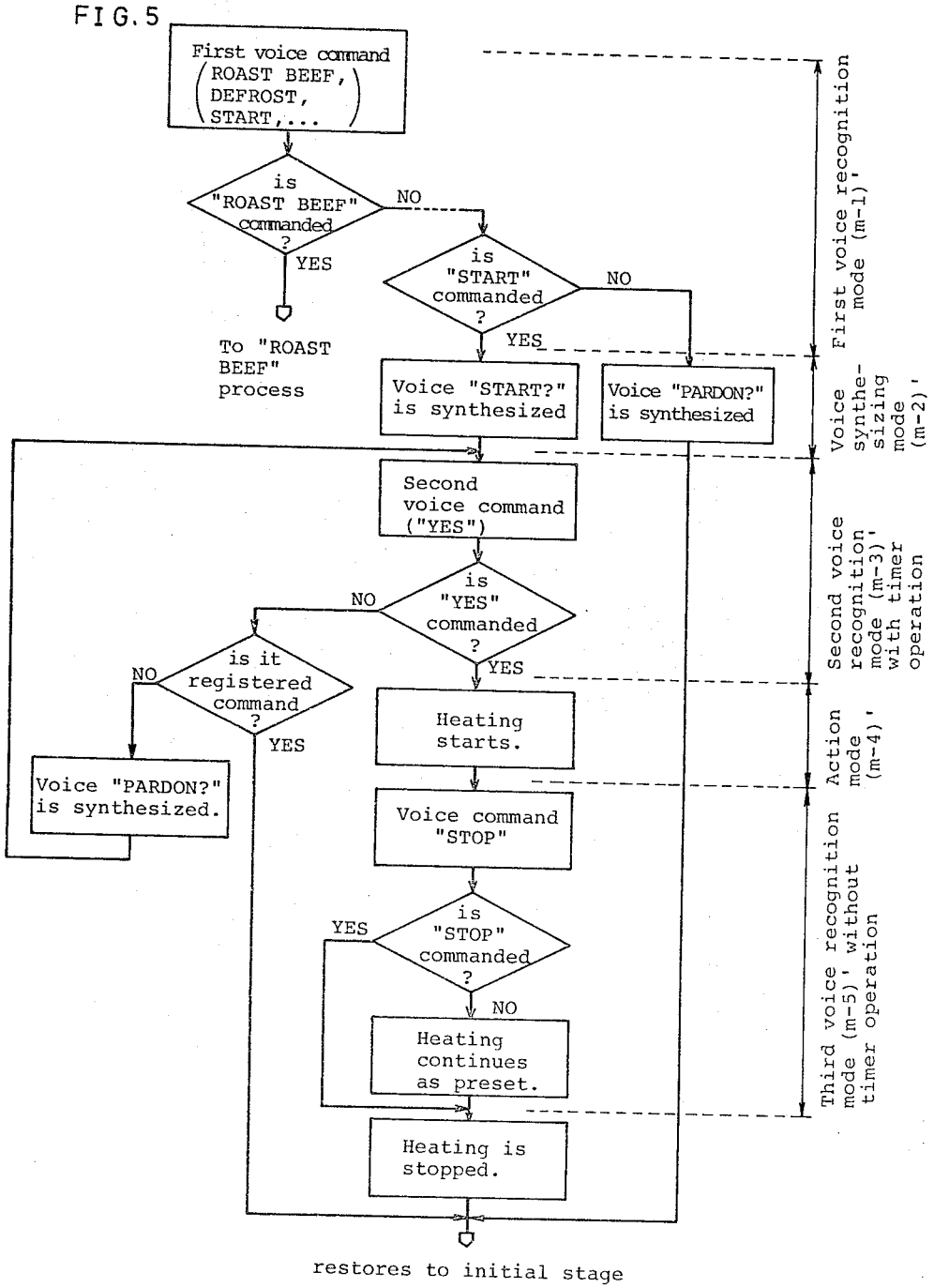
FIG. 5 is a program flow diagram showing a program of recognition for a command to start a heating in the embodiment.

After the kinds of heating sequence has been selected, the final process of heating starts when a voice command of "START" given to the apparatus is recognized. Such starting process is provided for the sake of safety. The one example of the program flow chart of the voice-commanded starting process is shown in FIG. 5. When an electric heater such as nichrome heater wire as a heating means is electrified for an excessively long time with respect to the heating object, the enclosure case and/or, the chamber door becomes excessively hot, thereby exposing a user to a risk of getting burned. When a microwave heating means is erroneously electrified without the heating object in the heating chamber, due to non-existence of the heating load of a microwave oscillator, the microwave radiation is likely to leak out of the door or the magnetron of the oscillator is likely to deteriorate thereby reducing its lifetime. Therefore, the starting of the heating action of the heating apparatus must be decided prudently through some checking process, and especially such safety measure is needed for the voice command switching system. Therefore, the program of voice command heating apparatus is constituted with a safety's arrangement as shown in FIG. 5, wherein an actual heating action occurs only after passing two command voice recognizing steps. As shown in FIG. 5, after completion of the recognitions to select a desired kind of heating sequence, for example, "ROAST BEEF" and "MEDIUM", the program comes to a first voice recognition mode (m-1)' where the command of "START" begins with a first voice command input of a registered word "START". When the voice command "START" is recognized, the synthesized voice issued an enquire "START?" for confirmation. Only when the user answers "YES" within a predetermined time of a timer, the operation mode changes to the enforcing mode (m-4)'. By provision of such dialogue type operation, namely, enquiry in the voice synthesizing mode (m-2)' and subsequent second voice recognition mode (m-3)' with the timer operation, an inadvertency-caused or a noise-caused erroneous operation of starting the heating can be substantially eliminated.

Even the abovementioned part of the starting program has a structure with several check points, there might still arise an erroneous operation due to misunderstanding or miscalculation which might cause an overheating or burning of the heating object. When such overheating or burning occurs, the heating must be stopped instantly. In order to assure safety, the apparatus must provide a program of an interrupting stopping of the preset heating sequence. A third voice recognition mode (m-5)' drawn in FIG. 5 is provided for the abovementioned reason. The third voice recognition mode (m-5)' has a registered voice command "STOP", and when this "STOP" voice command is recognized, the heating action is immediately stopped without passing through the hitherto described confirming enquiry and answer recognition.

Furthermore, after starting of the heating in the enforcing mode (m-4)', only possible alteration of the preset heating sequence is the stopping. In other words, after a starting of the heating, no alteration of the heating sequence is accepted. This is for the prevention of an erroneous alteration of heating time to undue dangerous length or the like. The third voice recognition mode is realized by modifying the second recognition mode (m-3)' and the elimination of the limit by the timer.

As shown in FIG. 5, in the first recognition mode (m-1)', the recognition step of the "START" command is made at a last stage. And, when the input first voice command in FIG. 5 cannot be recognized with the registered pattern, the synthesized voice enquires by "PARDON?" in the voice synthesizing mode (m-2)' and restores the operation to the initial stage, which is the stage to wait for another first voice command (such as "ROAST BEEF" of FIG. 3) is given.

When the operation is restored to the initial stage of FIG. 3 after synthesizing of "PARDON?" in the voice synthesizing mode (m-2)', the user tries to give more clear and/or correct voice command, so that the recognition circuit recognizes the voice command. Another voice synthesized enquiry "PARDON?" is issued in the second recognition mode (m-3)' of FIG. 5, when the recognition result indicates that the second voice command is not found within the registered command voices pattern. In this case, the operation is brought back to the beginning stage of the second voice recognition mode (m-3)' of FIG. 5. Therefore, the user can continue the operation only by giving the second voice command for the second recognition mode (m-3)' of FIG. 5.

Enquiry by voice command "PARDON?" from the user to the apparatus can be employed. However, this user's enquiry is accepted only in the second recognition mode as shown in the mode (m-3)'' of FIG. 13, which will be elucidated later. When the apparatus recognizes such "PARDON?" from the user, it repeats the immediately preceding synthesized voice.

The circuit structure of an example of the apparatus in accordance with the present invention is elucidated hereinafter referring to the drawings of FIGS. 6, 7, 8, 9, 10(*a*), 10(*b*), 10(*c*), 11, and 12.

Figure 6:
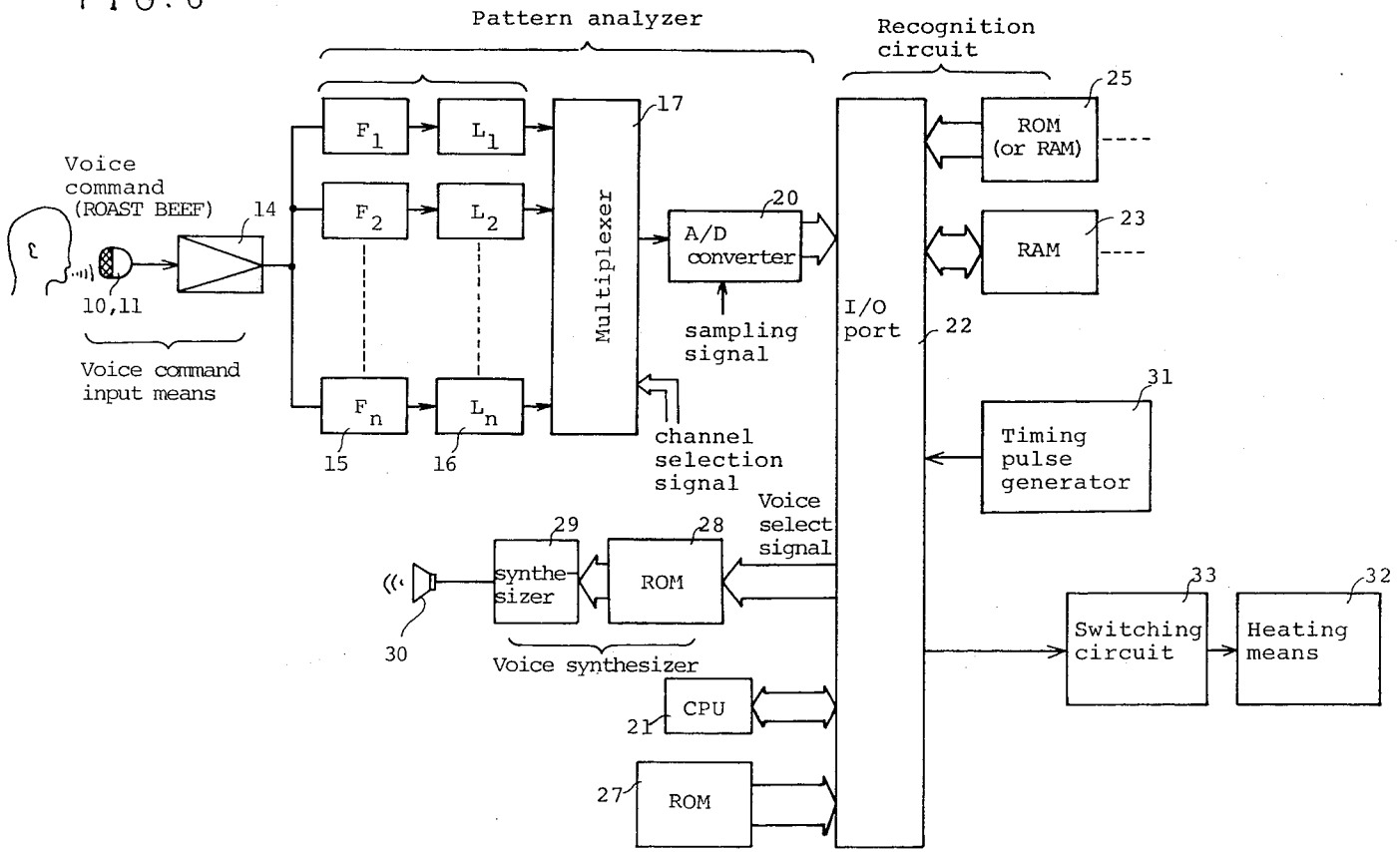
FIG. 6 is a circuit block diagram of the embodiment.
Figure 7:
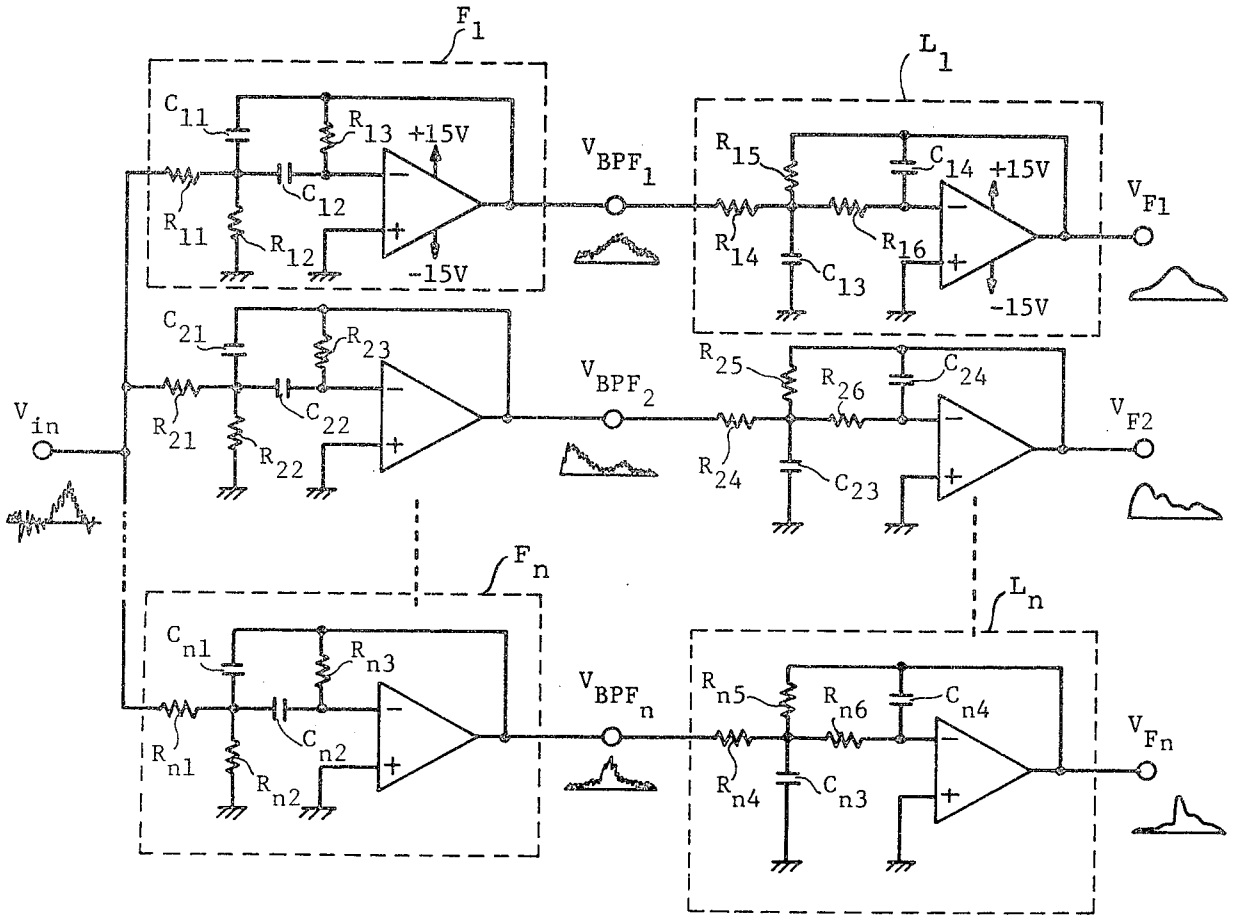
FIG. 7 is a circuit diagram of an example of a filter bank of the embodiment.
Figure 8:
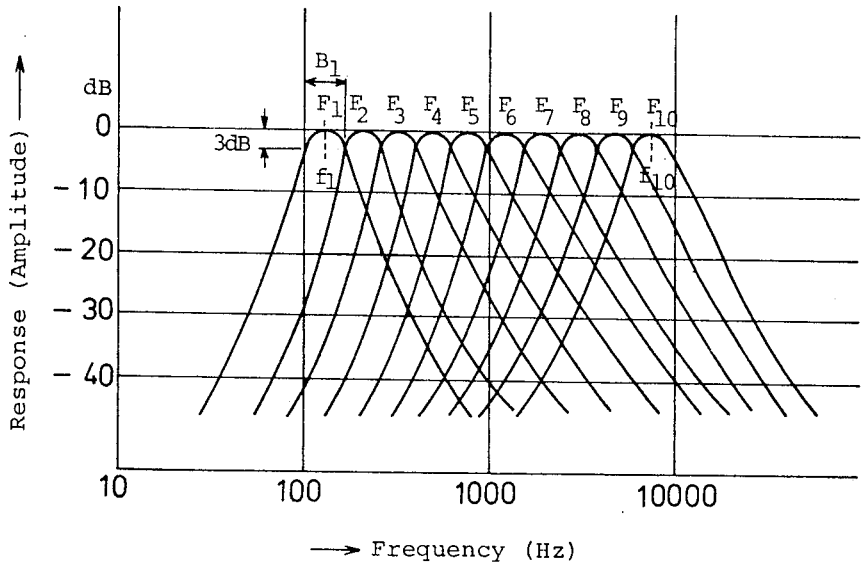
FIG. 8 is a frequency characteristic graph of band-pass filters of the filter bank of FIG. 7.

In FIG. 6, the microphone 10 or 11 receives the user's voice command and converts the voice command to a voice electric signal, which is amplified by an amplifier 14. The voice electric signal is then led to a filter bank comprising a plurality of band-pass filters 15 and low-pass filters 16. FIG. 7 shows an example of an actual circuit structure of such a filter bank, which comprises multiple feed-back type bandpass filters $F_1$, $F_2$, . . . , and $F_n$, and multiple feed-back type low-pass filters $L_1$, $L_2$, . . . , and $L_n$. The band-pass filters $F_1$ to $F_n$ have frequency characteristics as shown in FIG. 8. In this example, frequency range of 100 Hz to 10 KHz is covered by ten band-pass filters. The center frequencies $f_j$ and the band width $B_j$ ($j=1, 2, \ldots, 10$) are designed as shown in FIG. 8.

Figure 9:
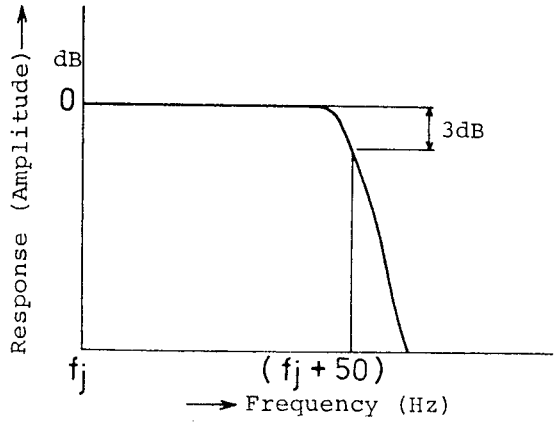
FIG. 9 is a frequency characteristic graph of low-pass filters of the filter bank of FIG. 7.
Figure 10:
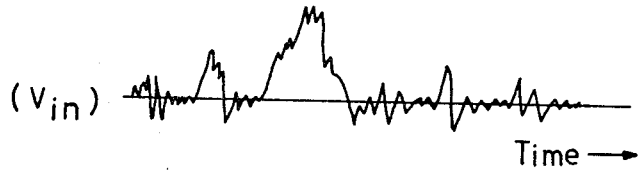
FIGS. 10(*a*), 10(*b*) and 10(*c*) are frequency characteristic graphs of various parts of the filter bank.
Figure 10:
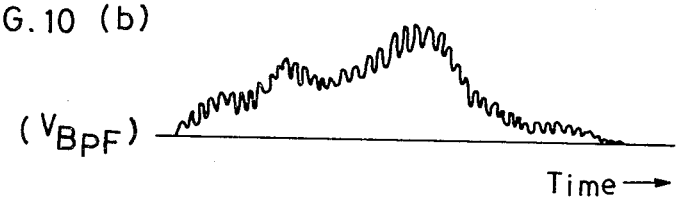
Figure 10:
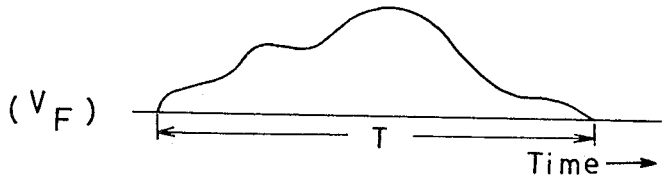
Figure 11:
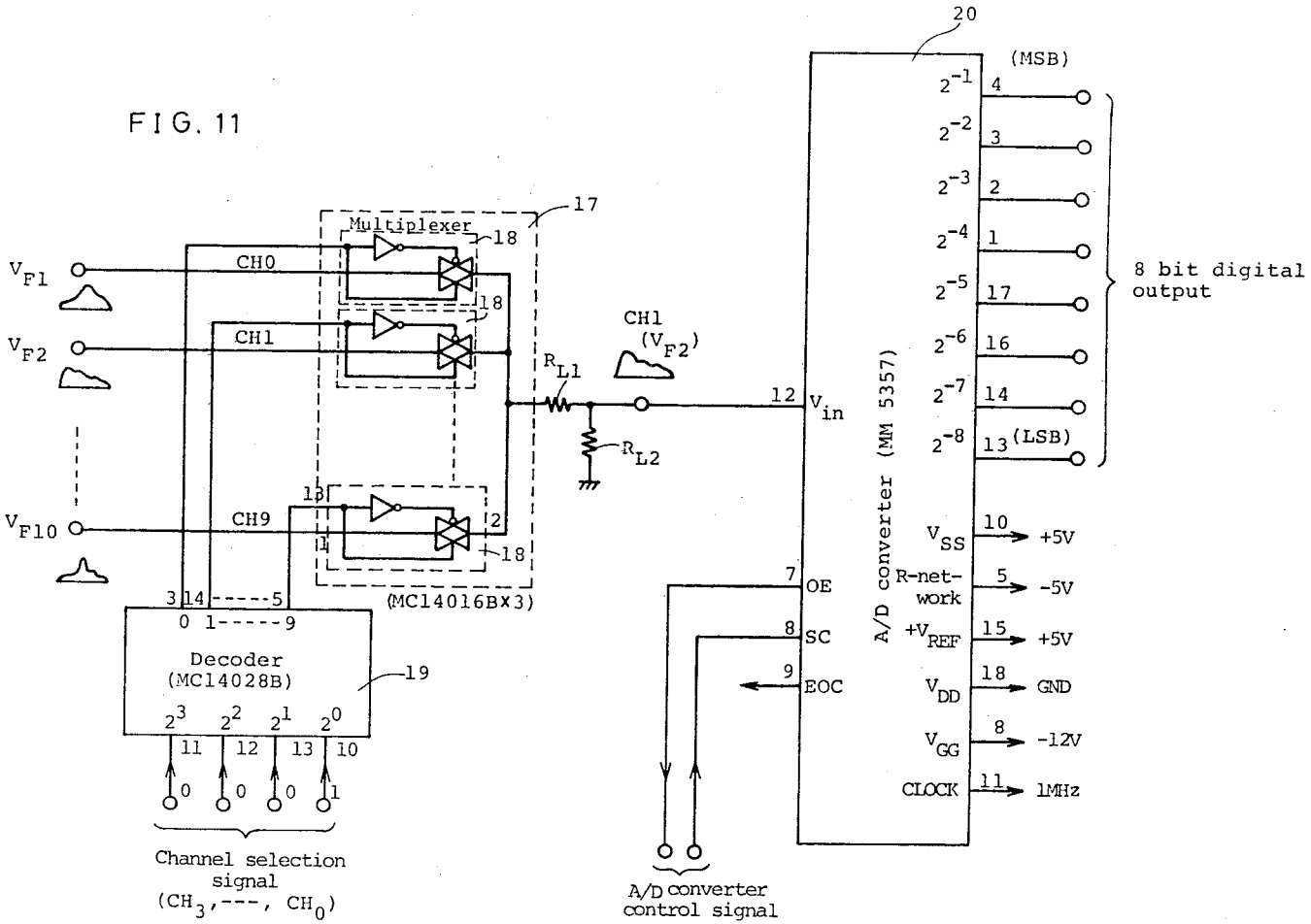
FIG. 11 is a circuit diagram of an analog multiplexer and an A/D converter.

The low-pass filters $L_n$ have the cut-off frequencies as shown in FIG. 9. In the example, all of the low-pass filters $L_n$ are of multiple feed-back type having the cut-off frequencies of 50 Hz. By using such a filter bank, a voice command signal $V_{in}$ is analyzed into waveforms in ten frequency bands. FIG. 10(*a*) shows a waveform of the voice command signal $V_{in}$, and FIG. 10(*b*) shows a waveform of an output signal $V_{BPF}$ from one of the band-pass filters $F_1$, . . . , and $F_{10}$. As shown in FIG. 10 (*b*), the waveform of the signal $V_{BPF}$ contains pitch (oscillation frequency of the vocal chords) of the user's voice, and therefore, the signal $V_{BPF}$ is passed through the low-pass filter to remove the pitch and obtain a filter bank output $V_F$ of a smoothed envelope waveform as shown by FIG. 10(*c*). The larger the number of the filters, the better the voice pattern can be analyzed. However, many filters renders the apparatus too large, and therefore, a reasonable number for a home-use utensil should be selected by considering a suitable recognition ability and response speed of the control system from both aspects of software and hardware. For the case that an 8-bit microprocessor is used for its control part, 10 filters both for the band-pass filters $F_j$ and low-pass filters $L_j$ are empirically found suitable or effective. The output signals of the low-pass filters $L_1$, $L_2$, $L_3$, . . . , $L_n$ are led to an analog multiplexer 17, and then the output of the multiplexer 17 is subjected to sampling by an A/D converter 20. The multiplexer 17, as shown in FIG. 11, comprises ten analog switches 18, which are formed by, for example, three C-MOS devices of MC14016B (a four-circuit analog switch) produced by Motorola Inc. Channel switching is operated by a channel selection signal sent from a CPU (central processing unit) in the main control unit. A decoder 19 decodes a 4-bit binary type channel selection signal into a 10-bit channel selection signal to be given to the multiplexer 17. The decoder 19 is structured by using a BCD-to-Decimal Decoder of MC14028B produced by Motorola Inc. For example, when a "0001" signal is input, the decoder 19 outputs a signal for channel 1 (CH1). Accordingly, the signal $V_{F2}$ is sent to the output terminal of the analog multiplexer 17. By switching the channel selection signal in the similar manner, outputs of ten filters of the filter bank are issued in turn at the output terminal of the multiplexer 17.

Then, the output signals of the filter bank are sent to the A/D converter 20 and converted into 8-bit digital signals. The A/D converter 20 is formed by, for example a monolithic A/D converter MM 5357 of National Semiconductors Inc. By adjusting resistances of load resistors $R_{L1}$ and $R_{L2}$, the analog input signal is adjusted to be within ±5 V. The input terminal SC(8) of the A/D converter 20 receives a start conversion signal, by which the filter bank output signals are sampled with a period of between 1 and 10 m sec. With such a period, satisfactory voice recognition by pattern characteristic can by made when the voice waveform is handled as envelope signals. The input terminal EOC(9) receives an end-of-conversion signal, and the output terminal OE(7) outputs an output-enable (OE) signal having effective timing of the 8-bit digital output signal. The CPU 21 in turn samples the filter bank outputs by means of the SC signal, sweepingly receiving the channel selection signal, and converts them into 8-bit digital data. The abovementioned processing is made by using the OE signal as monitor.

Figure 12:
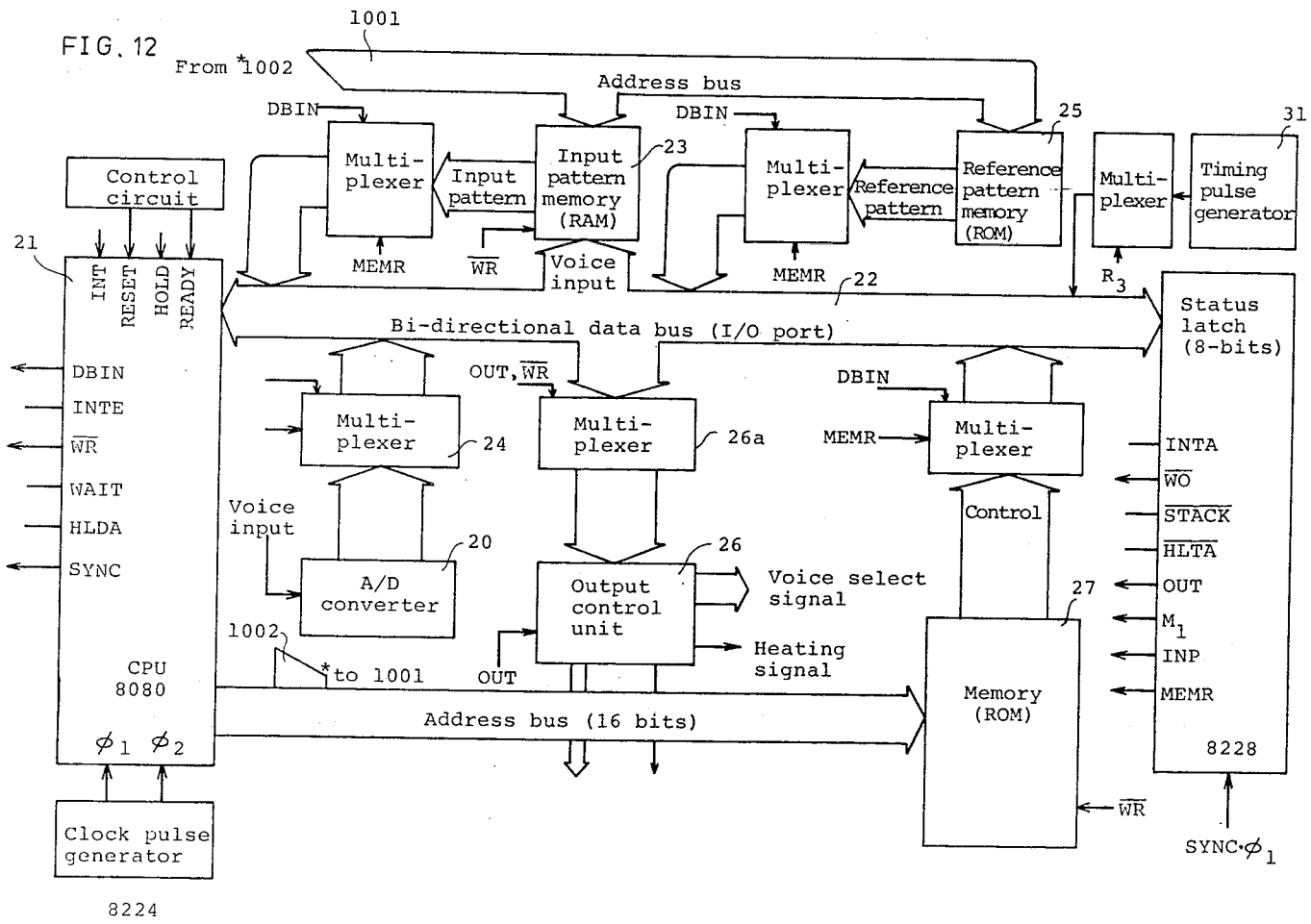
FIG. 12 is a block diagram of the structure of the circuit of FIG. 6 including a CPU (central processing unit).

FIG. 12 shows a block diagram of one example of a voice recognition and processing system including a CPU as a main control unit. A CPU 21 is constituted by using an 8-bit micro-processor, such as an Intel 8080. The voice data signal (8-bit digital signal) is written into the input pattern memory 23 through the I/O port 22. That is, the 8-bit voice data signal issued from the A/D converter 20 is sent to the I/O port 22 (bi-directional data bus) in a data reading mode under the control of the multiplexer 24. The voice data signal is once written into the input pattern memory 23 by a control signal from the CPU 21. Following such processes, the voice input data are analyzed in every divided frequency band, are sampled by the multiplexer 24 and the A/D converter 20, and then stored in the input pattern memory 23.

Then by detecting the end of the voice input signal, the CPU 21 counts the time length T(FIG. 10(*c*)) of this voice input pattern, and normalizes this time length by utilizing a known dynamic programming (DP) technique, in which DP process the input voice pattern is compared with the reference pattern registered in the memory 25, and partial expansion or partial compression are carried out until the voice input pattern most coincides with the reference pattern, and a reference pattern with highest affinity with the input pattern is selected.

For more information on the DP technique applied for the voice recognition, reference is made to, for example IEEE Transactions on Acoustics, Speech, and Signal processing, Vol. ASSP-26, No. 1, pp. 43–49, February 1978, and Vol. ASSP-27, No. 6, pp. 588–595, December 1980.

By means of the abovementioned recognition process, the voice input signal is defined as coincided with the selected reference pattern, and therefore, a specified output signal is given to an output control unit 26 through a multiplexer 26*a*. Thereby, a heating strat signal, a voice select signal for synthesizing voice, the aforementioned channel selection signal or sampling signal SC are issued with predetermined timings.

The memory 27 is a ROM which stores a control program of the CPU 21. In the abovementioned example, the reference voice pattern is registered in the ROM 25 for recognition of voice command of unlimited users. Besides the abovementioned example, a modified example can be made by replacing the ROM 25 by a RAM, so that voice commands of one or several limited users is preliminarily registered in the RAM 25 in order to easily obtain recognition of the user's voice with the stored reference pattern. In case such structure is employed, a single RAM can be used in place of the input pattern memory 23 and the reference pattern memory 25.

By the abovementioned structure and process, the voice command "ROAST BEEF" is recognized, and the CPU 21 issues based on the voice select signal an address signal for reading out an address for the signal to synthesize "MEDIUM?" in the ROM 28. Therefore, the voice data for the "MEDIUM?" is sent to the voice synthesizer 29, which then makes the synthesized voice signal "MEDIUM?" issue from the speaker 30. Such voice synthesizer 29 is available on the market, as a one chip synthesizer utilizing a known PARCOR synthesizing method for the voice synthesizing part.

The control unit then turns into the second recognition mode (m-3), and wait for the user's second voice command of "YES", "RARE", or "WELL-DONE". The user's command is recognized in the similar process to that of the recognition of the voice command "ROAST BEEF", and when the user's second voice command is "YES", the heating sequence for the MEDIUM is preset in the control system.

Numeral 31 (in FIG. 6) designates a timing pulse generator which issues input data to the timer to limit time period of the second recognition mode. The timer is also used for the control of the heating time control in the enforcing mode (m-4)'. Numeral 32 designates a heating load of the electric heater or the magnetron oscillator, and 33 a switching device to control power feeding to the electric heater or the magnetron oscillator. The control of the switching device can be made by the voice command of "START" or "YES".

Figure 13:
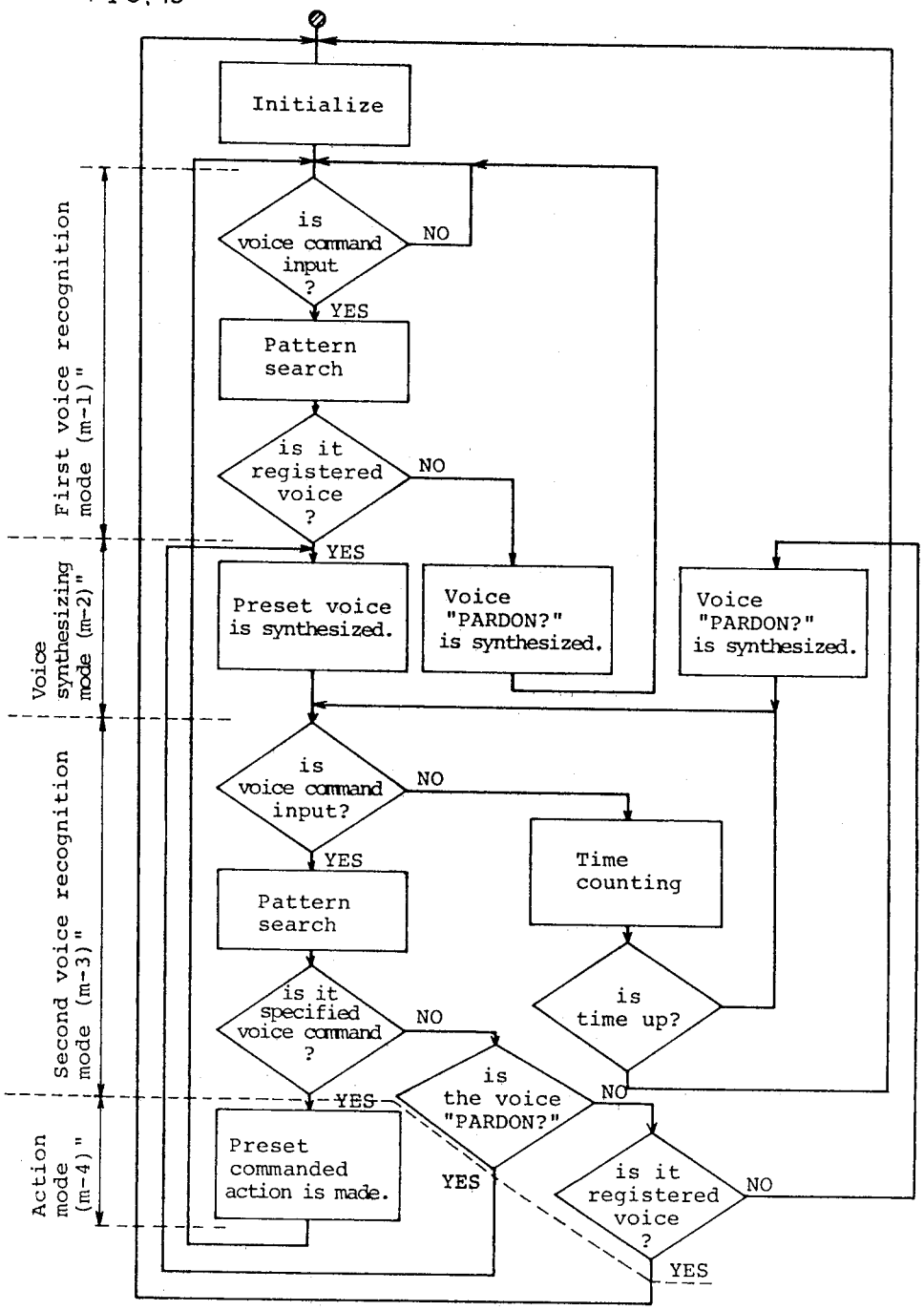
FIG. 13 is a program flow diagram of a general controlling mode of the CPU of FIG. 12.

FIG. 13 is a program flow chart showing is general the voice recognition process of the CPU system. As has been elucidated referring to FIGS. 3 to 5, the main control part switches the control system into four representative modes, the first voice recognition mode (m-1)", the voice synthesizing mode (m-2)", the second voice recognition mode (m-3)" and the action mode (m-4)". In the first voice recognition mode, the apparatus accepts any of registered voice commands. Then, when searching of the registered reference voice pattern fails to find a registered reference voice pattern with a necessary level of affinity to the input voice pattern, the voice synthesizer synthesizes the enquiring message "PARDON", and restores to the initial mode (m-1)". On the contrary, when the searching successfully finds a reference voice pattern with a necessary level of affinity to the input voice pattern, the apparatus is turned into the voice synthesizing mode (m-2)" where a predetermined voice such as "MEDIUM?" is synthesized, and thereafter is turned into the second voice recognition mode (m-3)". In this second voice recognition mode, only one of several predetermined command voices which is input within a preset time period is accepted. In order to attain such operation, a timer comprising the timing pulse generator 31 starts time counting from the time of entry into the second recognition mode. When no predetermined voice command is given within the preset time period, the first recognition is erased and the apparatus restores to the initial stage mode.

In the second recognition mode, besides the predetermined voice command such as "RARE" or "WELL-DONE" or "YES" which has some relation with the first voice command, user's voice "PARDON?" is accepted. When the user's command voice is "PARDON?", the apparatus repeats the synthesized voice and restores to the initial recognition mode (m-3)". When no preset registered reference voice pattern is given or found in the second recognition mode (m-3)", then the apparatus synthesizes "PARDON?" and restores to the second recognition mode.

When subsequent to successful recognition in the first recognition mode (m-1)', a second voice is successfully recognized thereby to produce the output control signal, then the apparatus turns to the action mode, where the actual switching on of the heating means is executed.

While the invention has been described in connection with what is presently considered to be the most practical and preferred embodiments, it is to be understood that the invention is not to be limited to the disclosed embodiments but on the contrary, is intended to cover various modifications and equivalent arrangements included within the spirit and scope of the appended claims which scope is to be accorded the broadest interpretation so as to encompass all such modifications and equivalent structures.

What is claimed is:

1. A heating apparatus comprising:

(a) an enclosure case having therein a heating chamber adapted to receive an object to be heated, the enclosure case having a door at an opening of said heating chamber, (b) a heating means for generating heating energy into said heating chamber, and (c) speech recognition and control circuit means comprising a voice command input means including a microphone for transforming user's voice commands into command input signals, the speech recognition and control circuit further comprising:

(d) a pattern analyzer for frequency-analyzing said command input signals to divide them into input pattern signals for a predetermined number of frequency bands, subsequently sampling said input pattern signals, and carrying out A/D conversion thereof to produce pattern-analyzed digital data, (e) an input pattern memory for memorizing said pattern-analyzed digital data in a form of time sequential patterns, (f) a reference pattern memory for storing time sequential reference pattern data as reference patterns, (g) a recognition processing circuit for comparing said pattern-analyzed digital data stored in said input pattern memory with said time sequential reference pattern data stored in said reference pattern memory, for issuing a signal indicative of an affinity degree of the comparison, and producing at least a predetermined control signal corresponding to recognized voice commands, when said signal of said affinity degree for one respective voice command among said user's voice commands is more than a preset signal level, (h) a voice synthesizer which, based upon said predetermined control signal of said recognition processing circuit, synthesizes a voice output signal, (i) a speaker for producing a sound upon receipt of said voice output signal, (j) a voice synthesizer memory, in which voice pattern data are preliminarily stored prior to operation of said heating apparatus, (k) a timer for counting a time period between an issuance of said voice output signal and a subsequent receipt of a second command input signal and (l) a main control unit for controlling the abovementioned component parts in a manner to have sequential operations comprising a first voice recognition mode, a voice synthesizing mode, a second voice recognition mode and an enforcing mode in this order, wherein in said first voice recognition mode, said main control unit makes said voice command input means receivable of any voice commands, and shifts said sequential operation to the voice synthesizing mode upon issuance of said predetermined control signal, in said voice synthesizing mode, said main control unit makes said voice synthesizer synthesize said voice output signal to ask said user tell a second voice command to said voice command input means, and immediately thereafter makes said sequential operation to said second voice recognition mode, in said second voice recognition mode, said main control unit makes said voice command input means receivable of only a limited number of predetermined voice commands, makes said sequential operation to said heating means switching mode when one of said predetermined voice commands is received by said voice command input means within said time period set by said timer, and makes the apparatus again operates in said first voice recognition mode when one of said predetermined voice commands are received by said voice command input means, and in said enforcing mode, said main control unit carrys out a program defined by the voice commands recognized in said first and second recognition modes.

2. A heating apparatus in accordance with claim 1, wherein in said first recognition mode and in said second recognition mode, when said recognition circuit and the output control circuit cannot find a predetermined affinity between said pattern-analyzed input signal and said pattern-analyzed reference signal, said main control unit reads out from said voice synthesizer memory control data to make said predetermined control signal for synthesizing a voice asking the user to repeat the preceding voice command, and send said control signal to said voice synthesizer, and upon completion of the voice synthesizing the mode restores to said first recognition mode or to said second recognition mode, depending upon the previous mode of operation.

3. A heating apparatus in accordance with claim 1, wherein said reference pattern memory stores an asking voice command having contents that the user asks the heating apparatus to repeat a synthesized voice issued immediately before, and upon recognition of said asking voice command in said second recognition mode said main control unit controls the operation to restore operation to said voice synthesizing mode thereby repeating said synthesized voice issued immediately before and thereafter restores the operation to aid second recognition mode.

4. A heating apparatus in accordance with claim 1, wherein said recognition circuit is inactivated while said voice synthesizer is issuing synthesized voice output signal.

* * * * *